US010321231B2

(12) United States Patent
Osterneck et al.

(10) Patent No.: US 10,321,231 B2
(45) Date of Patent: Jun. 11, 2019

(54) DETECTING AND COMPENSATING FOR PRESSURE DEVIATIONS AFFECTING AUDIO TRANSDUCERS

(71) Applicant: Google LLC, Mountain View, CA (US)

(72) Inventors: Josef Osterneck, San Jose, CA (US); Michael Kai Morishita, Belmont, CA (US); Chad Georges Seguin, Campbell, CA (US); Michael Scot Pate, Pleasanton, CA (US); Moonseok Kim, Santa Clara, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/717,249

(22) Filed: Sep. 27, 2017

(65) Prior Publication Data

US 2019/0098403 A1 Mar. 28, 2019

(51) Int. Cl.

| | |
|---|---|
| ***H04R 29/00*** | (2006.01) |
| ***H04R 3/00*** | (2006.01) |
| ***H04R 3/04*** | (2006.01) |

(52) U.S. Cl.

CPC ..... *H04R 3/007* (2013.01); *H04R 3/04* (2013.01); *H04R 29/00* (2013.01)

(58) Field of Classification Search

CPC ..... H04R 3/007; H04R 3/00; H04R 29/001; H04R 29/003; H04R 29/004; H03F 1/52; H03F 2200/331; H03F 1/30; H03F 2200/03; H03G 11/00; H03G 11/008; H03G 11/02; H03G 11/04; H04S 7/301; H04S 3/00

USPC ..... 381/55, 56, 57, 58, 59, 60, 94.9, 94.8, 381/94.1, 28, 61, 119, 120, 121, 103, 381/102, 101, 100, 99, 93, 83, 71.14, 381/71.12, 71.11, 71.1, 317, 318, 320

See application file for complete search history.

(56) References Cited

U.S. PATENT DOCUMENTS

| | | | | |
|---|---|---|---|---|
| 2005/0207584 | A1 | 9/2005 | Bright | |
| 2011/0275412 | A1 | 11/2011 | Khawand | |
| 2013/0077795 | A1 | 3/2013 | Risbo et al. | |
| 2014/0321690 | A1 | 10/2014 | Reining | |
| 2016/0050497 | A1* | 2/2016 | Daubigny | H04R 9/06 381/120 |
| 2016/0157014 | A1* | 6/2016 | Van Schyndel | H04R 3/007 381/55 |

(Continued)

FOREIGN PATENT DOCUMENTS

WO WO 2013133765 9/2013

OTHER PUBLICATIONS

PCT International Search Report and Written Opinion issued in International Application No. PCTUS2018031723, dated Jul. 12, 2018, 15 pages.

*Primary Examiner* — Leshui Zhang
(74) *Attorney, Agent, or Firm* — Fish & Richardson P.C.

(57) ABSTRACT

In general, the subject matter described in this disclosure can be embodied in methods, systems, and program products for analyzing, by a computing system, one or more signals transmitted to an audio transducer. The computing system determines, based on the analyzing the one or more signals, an inductance of electronic components affecting the one or more signals. The computing system modifies, based on using the determined inductance to determine that atypical displacement of the membrane of the audio transducer has occurred, the one or more signals to compensate for the atypical displacement of the membrane of the audio transducer.

16 Claims, 6 Drawing Sheets

(56) References Cited

U.S. PATENT DOCUMENTS

2017/0223467 A1* 8/2017 Jensen ..... H04R 25/305

* cited by examiner

DETECTING AND COMPENSATING FOR PRESSURE DEVIATIONS AFFECTING AUDIO TRANSDUCERS

BACKGROUND

Electronic devices that include a speaker are often designed to equalize pressure on both sides of the speaker to ensure optimal audio output. Some electronic devices that have been designed to be waterproof, however, may not be capable of quickly compensating for a sudden increase in the pressure on one side of the speaker with respect to the other side of the speaker (due to, for example, a user sitting on the electronic device, a user pressing sides of the device, or addition or removal of a protective device case). Such a pressure disparity across a membrane of a speaker may cause the membrane of the speaker to deviate from its resting position. This deviation (also referred to as a mechanical offset or displacement) may degrade the quality of audio that is output by the speaker.

SUMMARY

This document describes techniques, methods, systems, and other mechanisms for configuring electronic devices to monitor electronic signals transmitted to a speaker, determine that atypical displacement of a speaker membrane has likely occurred, and modify electronic signals subsequently transmitted to the speaker to compensate for the displacement.

As additional description to the embodiments described below, the present disclosure describes the following embodiments.

Embodiment 1 is a method. The method includes analyzing, by a computing system, one or more signals transmitted to an audio transducer. The method includes determining, by the computing system and based on the analyzing the one or more signals, an inductance of electronic components affecting the one or more signals. The method includes modifying, by the computing system and based on using the determined inductance to determine that atypical displacement of the membrane of the audio transducer has occurred, the one or more signals to compensate for the atypical displacement of the membrane of the audio transducer.

Embodiment 2 is the method of embodiment 1, wherein: the one or more signals transmitted to the audio transducer include an oscillating audio signal; and modifying the one or more signals transmitted to the audio transducer includes adjusting a DC component of the oscillating audio signal to compensate for the effects of the atypical displacement of the membrane of the audio transducer.

Embodiment 3 is the method of embodiments 1 or 2, wherein the one or more signals transmitted to the audio transducer includes an oscillating audio signal; and modifying the one or more signals transmitted to the audio transducer includes adjusting a gain of the oscillating audio signal to limit or prevent asymmetric clipping of the membrane of the audio transducer resulting from the atypical displacement of the membrane of the audio transducer.

Embodiment 4 is the method of embodiment 3, wherein adjusting the gain of the oscillating audio signal includes reducing a gain of one or more first frequencies of the oscillating audio signal while not reducing a gain of one or more second frequencies of the oscillating audio signal, or modifying the gain of the one or more second frequencies of the oscillating audio signal in a different manner than the reduction in gain to the one or more second frequencies of the audio signal.

Embodiment 5 is the method of any one of embodiments 1 through 4. The method includes determining, by the computing system and based on the analysis of the one or more signals transmitted to the audio transducer, that the membrane of the audio transducer is experiencing asymmetric clipping; wherein modifying the one or more signals transmitted to the audio transducer is further based on having determined that the membrane of the audio transducer is experiencing asymmetric clipping and the modification limits the asymmetric clipping of the membrane of the audio transducer.

Embodiment 6 is the method of embodiment 4, wherein determining that the membrane of the audio transducer is experiencing asymmetric clipping includes determining that a characteristic of the one or more signals transmitted to the audio transducer are experiencing clipping.

Embodiment 7 is the method of any one of embodiments 1 through 6, wherein determining that atypical displacement of the membrane of the audio transducer has occurred using the determined inductance includes determining that a relationship of the determined inductance to voltage or current has offset at least a threshold amount of volts or amps with respect to an expected relationship of inductance to voltage.

Embodiment 8 is the method of any one of embodiments 1 through 7, wherein determining the inductance of the electronic components includes analyzing (i) a current signal that is an input signal for an amplifier of the audio transducer, and (ii) a voltage signal across the amplifier of the audio transducer.

Embodiment 9 is the method of any one of embodiments 1 through 8, wherein modifying the one or more signals transmitted to the audio transducer to compensate for the atypical displacement includes reducing a level of the modifying of the one or more signals over a period of time based on pre-determined information that indicates a rate of depressurization.

Embodiment 10 is a system that includes an audio transducer; one or more processors; and one or more computer-readable devices including instructions that, when executed by the one or more processors, causes the performance of operations that perform the methods of any one of embodiments 1 through 9.

Particular implementations of the disclosed technology may, in certain instances, realize one or more of the following advantages. The technology described in this disclosure involves analyzing electrical signals that are transmitted to a speaker to detect that a transducer membrane of the speaker is experiencing atypical displacement and modifying electrical signals that are subsequently-transmitted to the speaker to compensate for the atypical displacement to the transducer membrane of the speaker. As such, the technology described herein enables an electronic device to at least partially limit the degradation in noise production that often results from atypical pressure deviations. This may be achieved by modifying electrical signals provided to a transducer rather than by manipulating other mechanical components.

Using electrical signals to compensate for atypical displacement of a transducer membrane does not foreclose the use of mechanical solutions as well. Still, some techniques which mechanically adjust electronic devices to compensate for changes in pressure within the device with respect to the outside of the device may produce adverse effects on audio output quality. Moreover, a device may be configured to electrically detect pressure deviation without adding an additional mechanical component to the electronic device (such as a separate sensor). As such, electrical detection of transducer membrane displacement and compensation therefore may provide various advantages over alternative approaches, such as reducing the total size and/or cost of an electronic device employing such techniques.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
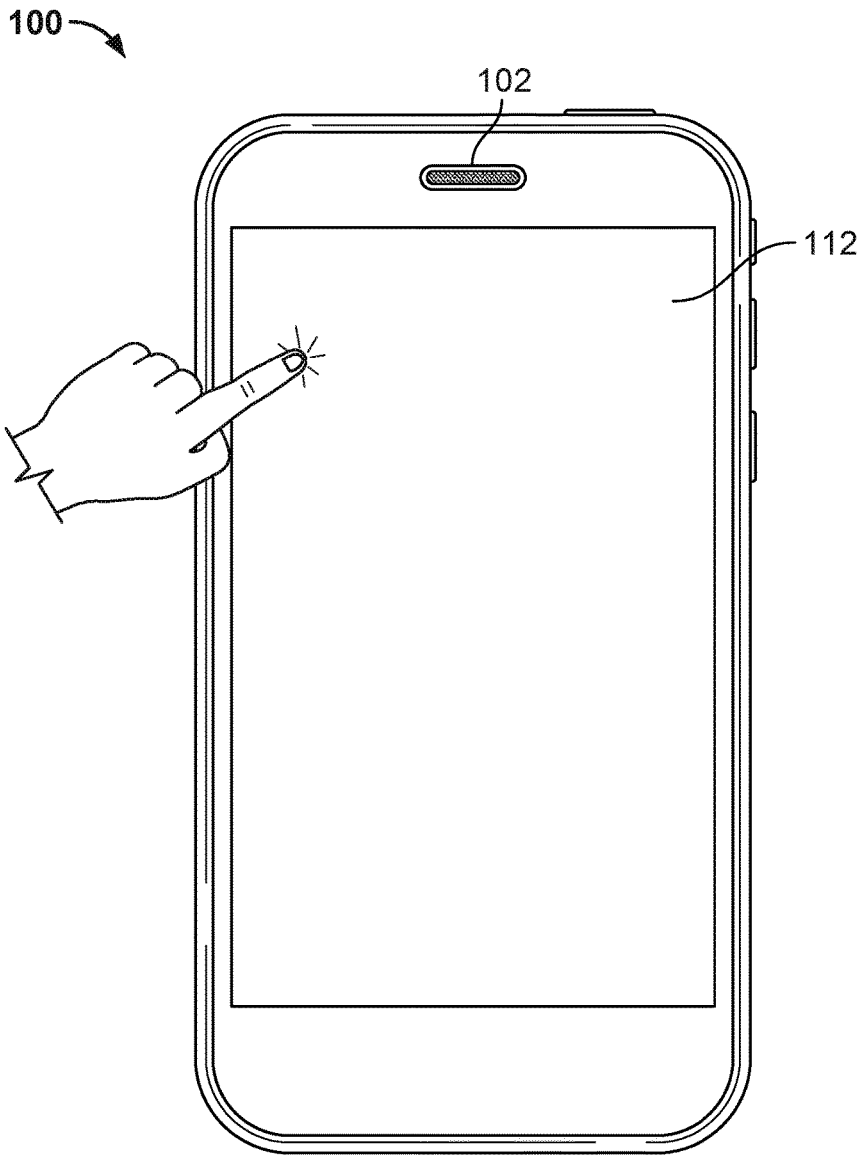
FIG. 1 is a diagram of user input applying pressure to an electronic device that includes components configured to detect atypical displacement of a transducer membrane and compensate for such displacement.

FIG. 1 is a diagram of user input applying pressure to an electronic device 100 that includes components configured to detect atypical displacement of a transducer membrane and compensate for such displacement. The electronic device 100 (which is illustrated as a mobile phone in FIG. 1) is waterproof or water resistant. In order to accomplish such water-proofing or resistance, membranes are present at various openings that would otherwise expose internal portions of the electronic device 100 to external atmospheric environment. Each membrane may be a thin sheet of a semi-rigid material that serves as a barrier to prevent liquids, such as water, from entering into the electronic device 100 through a respective opening and potentially damaging electrical components.

Such membranes may also limit air flow into and out of the electronic device 100. Air may exit the interior of the electronic device 100 through a membrane, but that release may be slower than if the membrane was not present. Air may also exit the interior of the electronic device 100 through a vent, but air release through that vent may also be gradual.

When a user applies pressure to the electronic device 100 by, for example, pressing on a touchscreen 112 of the device 100 (as illustrated in FIG. 1), pressure may increase in the electronic device 100, pushing air out of the electronic device 100 through the surface openings of the electronic device 100, for example a membrane or vent of the electronic device. Once the user stops pressing the touchscreen 112, the electronic device 100 may attempt to flex back to its normal position, reducing air pressure in the electronic device 100 and drawing air back into the electronic device 100 to equalize the pressure with the ambient environment.

In some cases, the amount of time that a device takes to equalize its internal pressure to the ambient pressure after a pressurization event (e.g., someone sitting on the phone) is known. For example, the time constant for pressure equalization may be known for a particular device or type of device through testing. After a time period equal to the time constant has passed, one may assume that the pressure within a device has decreased a particular amount (e.g., 63%) with respect to the ambient pressure. Accordingly, given a certain starting pressure, a known time constant, and a particular amount of time that has passed, the electronic device 100 may be able to calculate the expected pressure within the mobile device at that particular time.

As long as the electronic device 100 is depressurizing, there remains a difference between the ambient pressure and pressure internal to device 100 (e.g., relatively higher pressure inside of the electronic device 100 and relatively lower pressure outside of the electronic device 100). This difference in pressure may displace a membrane of speaker 102, for example, pushing the membrane outward due to the pressure inside of the device being greater than the pressure outside of the device. As long as there are unequal pressures are acting on the membrane, the audio that is output by the speaker 102 (e.g., a ringtone or an alert) may differ from an audio output expected if there were equal pressures acting on both sides of membrane.

As some background regarding speaker operation, the membrane (also called a diaphragm) of the speaker 102 oscillates to produce sound waves in the air, therefore producing noise. This membrane does so by oscillating back and forth past a determinable center location, which may be the same as the location at which the membrane is at rest when no electrical signal is provided to the speaker 102 (and when the pressure on both sides of the membrane are equal). When there is an imbalance in pressure across the sides of the membrane, the resting location of the membrane may be physically offset from the resting location that would be expected if there were no pressure deviation. This behavior is similar to how a balloon tends to bulge outward when squeezed. As such, when the pressure inside of the electronic device 100 differs from that outside of the electronic device 100, the speaker 102 may oscillate when an oscillating electrical signal is applied to the speaker 102, but that oscillation may center around a different location (e.g., a location that is different than a location at which the membrane would be at rest if pressures were equalized).

These unequal pressures may cause the oscillations of the membrane to move further in a given direction than they otherwise would, potentially resulting in the membrane reaching the limits of its ability to extrude in that given direction as audio is playing. In other words, a signal that would not typically cause the speaker 102 to reach the limits of its movement in a given direction when pressures are equalized may hit such a limit due to atypical speaker displacement. This atypical speaker displacement an asymmetric clipping effect in which the speaker membrane is clipped or prevented from reaching the full range of its motion in one (but not both) directions. This clipping may result in audible distortion of audio output to a user.

Although FIG. 1 shows a user's hand pressing the electronic device 100, pressure deviation can also result from a user squeezing the electronic device 100, a user sitting on the electronic device 100, a user dropping the electronic device 100, and from other situations in which an external object contacts a portion of the electronic device 100 and compresses that portion of the electronic device 100 (e.g., which reduces the interior volume of the electronic device 100).

As a general description, the electronic device 100 is configured to monitor electronic signals transmitted to the speaker 102 (e.g., those signals provided to or received from the speaker 102), determine when analysis of these signals indicates that a displacement event has likely occurred, and modify the signals provided to the speaker to compensate for any such displacement. These analyses and determinations may involve analyzing known relationships between speaker membrane offsets and signal characteristics, such as inductance-to-displacement relationships, to detect for conditions that potentially cause audio signal distortion.

As an illustration, the electronic device 100 may infer that a magnet of the speaker 102 (and in turn, the membrane) is oscillating about a center location that is offset with respect to a resting position of the magnet, by measuring the current into, and the voltage across, the amplifier that provides electrical signals to and receives electrical signals from the speaker 102. The current and voltage measurements may be used to calculate real-time, changing inductance values for the amplifier and/or the speaker 102 as the speaker 102 oscillates. These real-time inductance values may be compared to expected inductance characteristics that are associated with nominal speaker conditions, which are represented by an inductance-displacement curve. Based on the comparison, the electronic device 100 may determine that the membrane is experiencing atypical displacement, for example, due to pressure inside the device being greater than or less than pressure outside of the device. In response to such a determination, the electronic device 100 may modify the audio signal that is provided to the speaker 102 to compensate for any signal degradation that may result from the atypical displacement (e.g., asymmetric clipping that results from the mechanical offset).

An additional or alternative mechanism to determine that the membrane is mechanically offset is to determine that the membrane is experiencing asymmetric clipping, for example, due to the membrane reaching limits of it excursion in only one direction. This determination may involve analyzing the electrical signal that is driving movement of the speaker 102 to determine that a clipping phenomenon is present in the electrical signal (e.g., a flattening of the electrical signal at a peak of its oscillation in only one direction).

The electronic device 100 may compensate for atypical displacement using various techniques. One technique involves adjusting the gain of the signals that are provided to the speaker 102, for example, by reducing the gain of the signals by an amount that is determined to avoid the asymmetrical clipping. For instance, the electronic device 100 may substantially, and quickly, reduce the gain by a predetermined amount upon determining that a membrane is experiencing atypical displacement. After reducing the gain, the electronic device 100 may gradually increase the gain as air flows in or out of the electronic device through one or more membranes or vents.

A second technique involves modifying the electrical signal transmitted to the speaker to affect the direct current (DC) component of the audio signal (e.g., the determined average of the audio signal), in a manner that has been determined to be likely to counteract any displacement of the membrane. As a simplified example, the electronic device 100 may skew an audio signal so that its components have a greater DC voltage in an amount and direction that would generate electromagnetic forces that oppose any membrane displacement and/or measured clipping (e.g., by forcing the membrane away from the exceeded excursion limit and back to a resting position of a membrane experiencing equalized pressures).

The electronic device 100 may continue to adjust the level at which the audio signal is modified, for example, so that the manipulation of the audio signal decreases over time. This decreasing manipulation of the audio signal may correlate to anticipated reductions in pressure as air flows through the one or more membranes of the mobile device. This "backoff" in signal modification may be performed using predetermined information that indicates a speed at which the pressure in the device is likely to normalize (e.g., a time constant of pressure normalization of the device).

In some examples, the electronic device 100 continues to analyze the impedance of the electronic signal as the pressure equalizes, to measure a speed at which the pressure equalizes. In other words, instead of the electronic device 100 backing off its level of signal modification based on a predetermined time constant or other static information, the electronic device 100 may back off its level of modification (or increase its level of modification in the case of increasing pressure) based on a runtime analysis of characteristics of the audio signal. In response, the electronic device 100 may update the level of compensation (e.g., either in gain or offset) applied to the audio signal. The electronic device 100 may repeat this process multiple times per second (e.g., 1, 2, 3, 5, 8, 10, 20, 100, 200 times per second), in order to slowly reduce the level of compensation applied to the audio signal.

In this manner, the electronic device 100 may modify audio signals when increasing pressure would normally distort those audio signals. The modification may involve lowering a volume of audio, but the audio may return to normal as electronic characteristics related to atypical pressure (e.g., atypical impedance) return to normal.

In some implementations, for example in the case of a mobile phone, the electronic device 100 may wirelessly communicate with a base station, which may provide the device wireless access to numerous hosted services through a network. In this illustration, the electronic device 100 is depicted as a handheld mobile telephone (e.g., a smartphone, or an application telephone) that includes a touchscreen display device 112 for presenting content to a user of the electronic device 100 and receiving touch-based user inputs. The electronic device 100 may be implemented as other mobile computing devices, other than the illustrated mobile telephone, such as a laptop, or tablet device. The electronic device 100 may also take alternative forms, including as a personal digital assistant, an embedded system (e.g., a car navigation system), a desktop personal computer, or a computerized workstation.

Other visual, tactile, and auditory output components may also be provided (e.g., LED lights, a vibrating mechanism for tactile output, or a speaker for providing tonal, voice-generated, or recorded output), as may various different input components (e.g., keyboard, physical buttons, trackballs, accelerometers, gyroscopes, and magnetometers). Example visual output mechanism in the form of display device 112 may take the form of a display with resistive or capacitive touch capabilities. The display device 112 may be for displaying video, graphics, images, and text, and for coordinating user touch input locations with the location of displayed information so that the electronic device 100 may associate user contact at a location of a displayed item with the item.

The electronic device 100 may include mechanical or touch sensitive buttons. Additionally, the device may include buttons for adjusting volume output by the speaker 102, and a button for turning the device on or off. A microphone allows the electronic device 100 to convert audible sounds into an electrical signal that may be digitally encoded and stored in computer-readable memory, or transmitted to another computing device. The electronic device 100 may also include a digital compass, an accelerometer, proximity sensors, and ambient light sensors.

An operating system may provide an interface between the device's hardware (e.g., the input/output mechanisms and a processor executing instructions retrieved from computer-readable medium) and software. The operating system may provide a platform for the execution of application programs that facilitate interaction between the electronic device and a user.

The electronic device 100 may include other applications, computing sub-systems, and hardware. A call handling unit may receive an indication of an incoming telephone call and provide a user the capability to answer the incoming telephone call. A media player may allow a user to listen to music or play movies that are stored in local memory of the electronic device 100. The electronic device 100 may include a digital camera sensor, and corresponding image and video capture and editing software. An internet browser may enable the user to view content from a web page by typing in an addresses corresponding to the web page or selecting a link to the web page.

In various implementations, operations that are performed "in response to" or "as a consequence of" another operation (e.g., a determination or an identification) are not performed if the prior operation is unsuccessful (e.g., if the determination was not performed). Operations that are performed "automatically" are operations that are performed without user intervention (e.g., intervening user input). Features in this document that are described with conditional language may describe implementations that are optional. In some examples, "transmitting" from a first device to a second device includes the first device placing data into a network for receipt by the second device, but may not include the second device receiving the data. Conversely, "receiving" from a first device may include receiving the data from a network, but may not include the first device transmitting the data.

"Determining" by a computing system may include the computing system requesting that another device perform the determination and supply the results to the computing system. Moreover, "displaying" or "presenting" by a computing system may include the computing system sending data for causing another device to display or present the referenced information.

Figure 2:
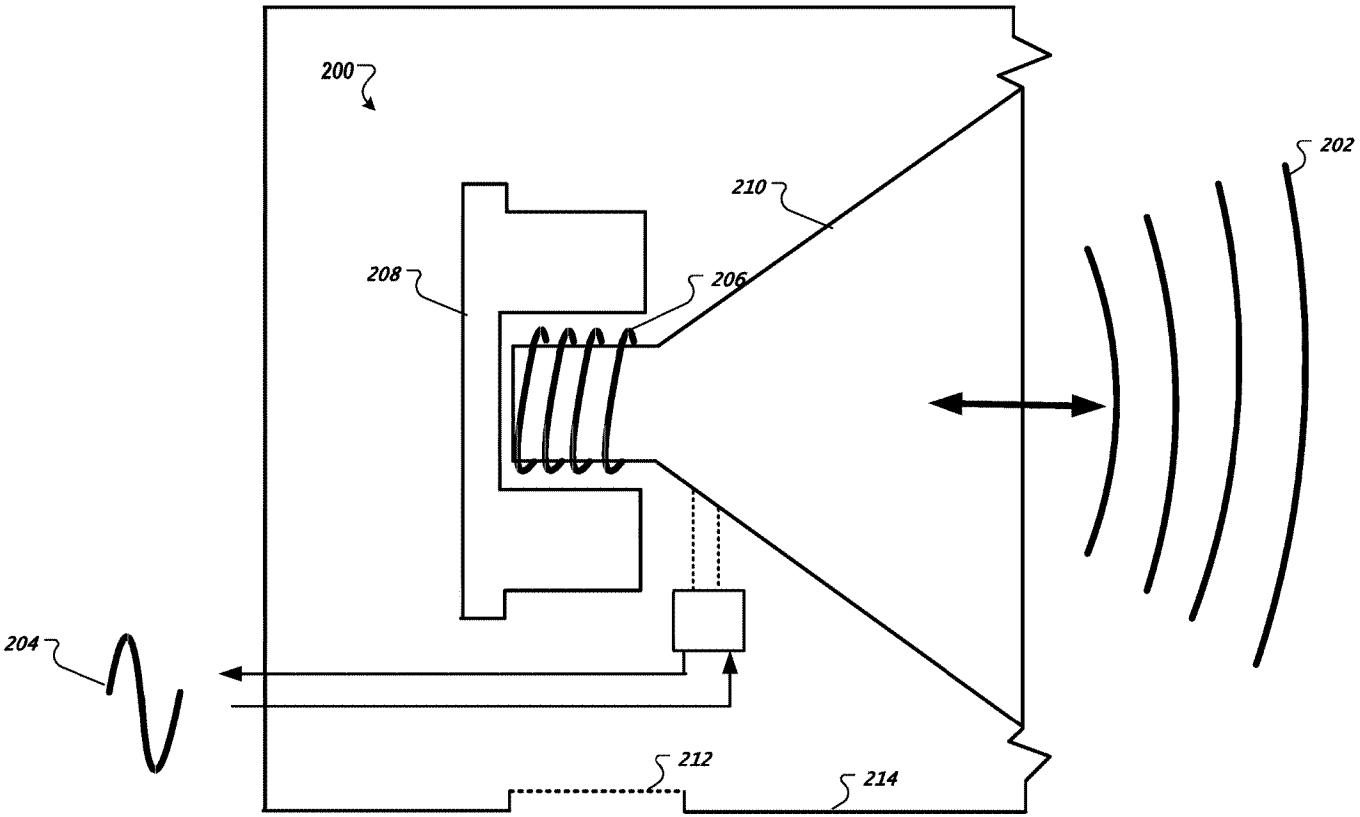
FIG. 2 is a schematic diagram of an audio transducer of an electronic device.

FIG. 2 is a schematic diagram of an audio transducer 200, or speaker, of an electronic device that may be used to implement the disclosed technology. As some background regarding operation of audio transducers, the audio transducer 200 may be configured to convert electrical energy into acoustic energy. Many variations of transducers exist, including a moving coil-permanent magnet transducer, which is illustrated in FIG. 2. The audio transducer 200 may be used by an electronic device to generate acoustic waves 202, generated from mechanical vibrations of transducer 200. Those vibrations may convey various sounds that are audible and/or intelligible to a user of the electronic device, such as, but not limited to alert noises, ringtones, music, and voice audio. The human ear may generally hear sounds from between 20 Hz to 20 kHz, and the frequency response of the audio transducer 200 may be tailored to operate within this frequency range.

FIG. 2 further illustrates that the audio transducer 200 may receive an electrical analog signal 204 as an input, and convert it into sounds waves that are substantially close to having the same characteristics (e.g., frequency, amplitude) as the electrical analog signal 204. FIG. 2 also shows transducer 200 including coil 206, which enables the transducer to function as a moving coil-permanent magnet transducer. In some cases, the transducer 200 may take other forms, including a moving magnet-permanent coil transducer, electrostatic transducer, isodynamic transducer, and piezo-electric transducer. In some implementations, the transducer 200 does not need to be for generating audio signals. For example, the transducer 200 may serve as a sensor or another type of output device.

As illustrated in FIG. 2, a waterproof or water-resistant membrane 212 may be located between an environment located at a front side of the membrane 212 and an environment located to a back side of the membrane 212. The membrane 212 may serve as a thin, air-permeable, flexible cover that at least partially acts as a barrier to pollutants of electro-mechanical components (e.g., water, liquids, dust) of the audio transducer 200.

As shown in FIG. 2, the audio transducer 200 includes a coil 206, which may be constructed using a thin wire that is suspended within a magnetic field generated by magnet 208. Additionally, the coil 206 may be used to function as an electromagnet, as the transducer 200 includes a soft metal core made into a magnet by the passage of electrical current through the coil 206 surrounding it, thus creating an electromagnetic field. The coil 206 is configured to move, or rotate, within the magnetic field. In some cases, the systems and techniques discloses herein are capable of detecting that the coil 206 is displaced (e.g., not centered) with respect to a typical resting position of the coil 206 (or is oscillating about a position that is not the typical resting position), thereby determining that there is a mechanical offset (also referred herein as a displacement event or pressure deviation event). For instance, in a scenario in which the coil 206 is not resting at its intended zero position because of a difference in pressure between the front and back of the speaker and is instead resting at a displaced position, as the coil 206 begins to oscillate back and forth about its displaced position, asymmetric clipping of the signal and therefore the sound waves produced by the speaker may occur. The system described in this disclosure may detect this displacement and/or the asymmetric clipping, and electrically compensate the audio signal to produce audio without distortion (or at least less distortion than otherwise would be present).

FIG. 2 additionally shows that the coil 206 is coupled to a diaphragm 210, which may be a cone shaped structure constructed of a paper or Mylar. The diaphragm 210 is illustrated as being suspended to a chassis 214, or a metal frame. As an example, when the analog signal 204, which may be an input voltage signal, passes through the coil 206 of the audio transducer 200, an electro-magnetic field is produced whose signal strength is determined by the current flowing through coil 206. Moreover, an amplifier may be used to drive the current through the coil 206. The electromagnetic force produced by the field opposes the main permanent magnetic field around it and tries to push/pull the coil 206 in one direction or the other depending upon the interaction between the north and the south poles of the magnet 208.

The coil 206 is attached to the diaphragm 210, which also moves in tandem, and its movement may cause a disturbance in the air around it, thus producing sound. In the instances in which the input signal 204 is a sine wave, diaphragm 210 may pulsate (e.g., in and out), pushing air as it moves and generating an audible tone that represents the frequency of the sine wave. The strength, and therefore the velocity, by which the diaphragm 210 moves and pushes the surrounding air may be determined at least in part based on the input signal 204 that is applied to the electromagnet 206.

Being that coil 206 is made of inductive material (e.g., metal wiring), the coil 206 (and similarly the transducer 200) have inductance and impedance characteristics. In some cases, the impedance of the coil 206 associated with normal operation, or the nominal impedance, may be in between 4 and 16 ohms of the speaker, when measured at 0 Hz, or DC. Thus, the nominal impedance and/or inductance of the audio transducer 200 may be used as known values by the system and techniques described herein (e.g., in combination with known characteristics of the amplifier that provides the analog signal 204). These known values may indicate a relationship between measurable electrical values, such as impedance, and correspondingly link them to expected mechanical characteristics, such as the expected position of the electromagnetic coil 206 (in relation to the magnet 208), and therefore the position of the membrane 212 when there is no offset. As an example, when the coil 206 is located at is designated zero position, or center, the techniques may predict that the calculated impedance and/or inductance of the transducer 200 should match its known value, or range of values.

The system and techniques described herein may calculate a real-time estimation of the position (and similarly displacement) of the components of the audio transducer 200, including the coil 206 and the membrane 212, based on the electrical parameters acquired while transducer 200 is reproducing audio. Those parameters may include, for example, a resistance and/or inductance of the transducer 200, a real and/or imaginary impedance of the transducer 200, and a current through and/or a voltage across the transducer 200, including similar values for the system as a whole, which may include accounting for such characteristics of the signal amplifier. As an example, the disclosed systems and techniques may utilize the system determined inductance (calculated from voltage and current) as a function to estimate the current position of the transducer coil 206. As such, measuring the system's electrical characteristics enables measuring a membrane displacement of the transducer 200.

The system may also predict position related characteristics, for example, a coil 206 velocity of the transducer 200 based on the system impedance. For example, the current through transducer 200 may be proportional to the speed of displacement of the membrane 212. In some cases, the output impedance of an amplifier may be matched with the nominal impedance of the transducer 200 to obtain maximum power transfer between the amplifier and transducer 200.

In some cases, a pressure deviation event, such as over pressure, under pressure, or difference between internal pressure and external pressure of an electronic device, may cause a static offset to the membrane 212. In other words, increased pressure to one side of the membrane 212 may move the membrane 212 a certain distance (e.g., 0.001 meters) from its zero position along the membrane's axis of movement. The distances for acceptable membrane movement in both directions along this axis away from the zero position (+y-axis direction, −y-axis direction) may be capped, or otherwise limited, by positive and negative excursion limits. As a pressure deviation becomes increasingly greater, for example, the membrane 212 moves farther away from its zero position, causing a resting offset that is increasingly closer to one of the membrane's excursion limits. In turn, if audio output from the transducer 200 is generated before pressure equalizes, the static offset, or displacement of the membrane 212, creates a condition in which the membrane 212 may reach one of its excursion limits if a large enough oscillating signal is applied to the transducer 200. This condition results in asymmetric clipping of an audible signal, and may result in a corresponding clipping to the electrical signal that is driving the transducer 200.

Furthermore, the level at which signal clipping occurs may be proportional to the amount of static displacement (e.g., the offset clipping level may be lower than a normal clipping level by an amount that is proportional to the static displacement). For instance, as the pressure difference from the inside to the outside of the electronic device increases, the greater the static offset of the membrane 212 may increase. Notably, the amount of time needed for pressure equalization may be proportional to the pressure difference (and thus the offset). These relationships between asymmetric clipping, static offset, membrane excursion limits, and DC membrane levels, are illustrated in FIGS. 3A-3B.

Figure 3A:
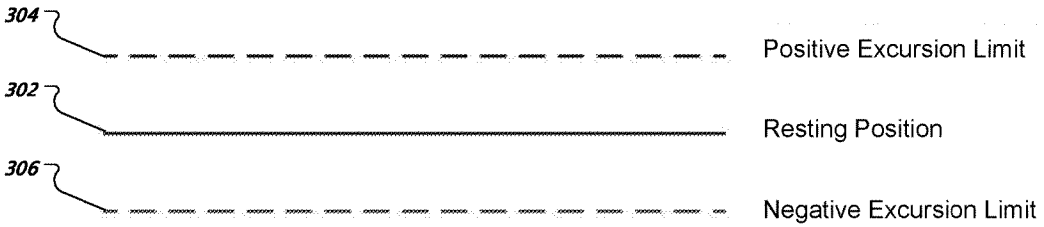
FIG. 3A illustrates a resting location of a transducer membrane when pressure is equalized across both sides of the transducer membrane.

FIG. 3A illustrates a resting location of a transducer membrane when pressure is equalized across both sides of the transducer membrane and no electrical signal is being provided to the transducer. The resting position may alternatively be referred to as a DC membrane level 302 or the zero position of the transducer. This resting position may be based on mechanical properties of the device in which the membrane is installed. In some examples, the resting position 302 is equidistant from the positive execution limit 304 and the negative excursion limit 306 of the device, as shown in FIG. 3A.

In the cases where a signal, for instance a positive current, is applied to the speaker, the electromagnetic forces displace the membrane from its resting position 302. When the input is a positive current, the membrane may vertically displace in the positive direction (i.e., +y-axis direction). Similarly, when a negative current is input to the speaker, the membrane may vertically displace in the negative direction. However, as illustrated in FIG. 3B, due to the DC membrane level 302 being an equal distance from the positive excursion limit 304 and the negative exclusion limit 306, there is ample room for the membrane to move and generate loud sound (e.g., high amplitude sound waves) without distortion from clipping.

Figure 3B:
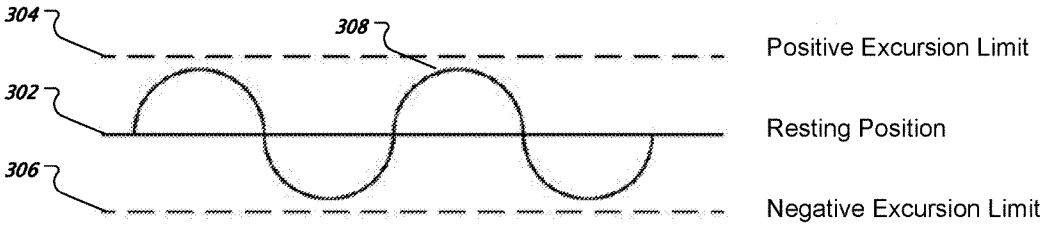
FIG. 3B illustrates movement of a transducer membrane when pressure is equalized across both sides of the transducer membrane.

The movement of the membrane illustrated in FIG. 3B is that that occurs when pressure is equalized across both sides of the transducer membrane. This is shown with the peak-to-peak amplitude of the sinusoidal signal 308 not reaching or exceeding either of the excursion thresholds. To be sure, it is possible for the oscillating signal 308 to experience clipping if the signal provided to the speaker has a great enough amplitude, it is just that that clipping may be symmetric (e.g., occurring at both positive and negative peaks). Also, a sinusoidal wave is presented here for illustrative purposes, but in some examples of complex audio (e.g., spoken words), the oscillating waveform may include multiple frequencies within the waveform, not just the one frequency.

Figure 3C:
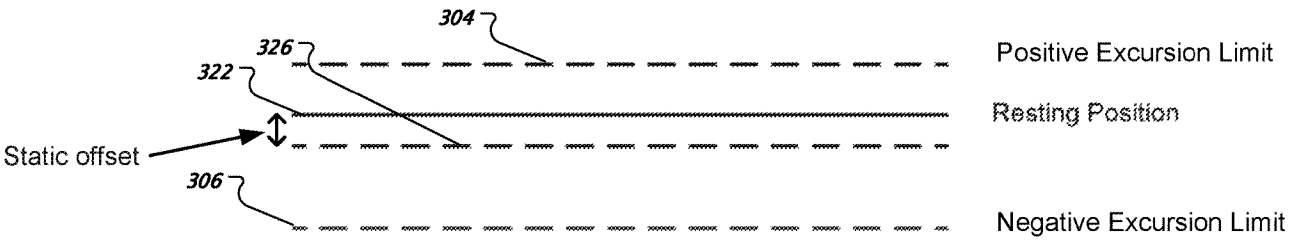
FIG. 3C illustrates a resting location of a transducer membrane when pressure is not equalized across both sides of the transducer membrane.

In the event that there is a pressure difference across the sides of the membrane, the membrane may be displaced into a non-zero state. This displacement is conceptually illustrated in FIG. 3C, which shows a resting location of a membrane when pressure is not equalized across both sides of the transducer membrane. As shown in FIG. 3C, the atypical resting position 322 of the membrane is statically offset from the typical resting position 322, even without current being provided to the speaker. In other words, the membrane is vertically shifted (e.g., in the +y-axis direction). The static offset here is illustrated as the difference between the typical resting position 326 and the atypical resting position 322. The static offset may be proportional or exponentially related to the difference in pressure between sides of the membrane.

Figure 3D:
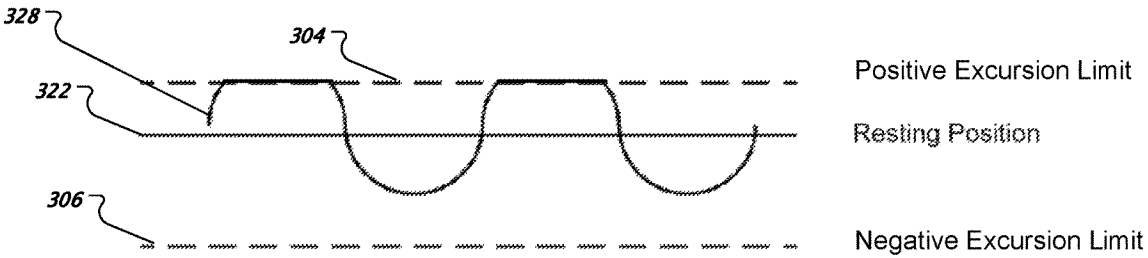
FIG. 3D illustrates movement of a transducer membrane when pressure is not equalized across both sides of the transducer membrane.

As discussed in detail in reference to FIG. 3A, the typical resting position 326 of the membrane is equidistant between the positive excursion limit 304 and the negative excursion limit 306. In this example, however, the atypical resting position 322 is closer to the positive excursion limit 304 by an amount that is related to the static offset. As such, should a large audio output signal 328 be applied to the speaker, as illustrated in FIG. 3D, the audio output signal 328 oscillates and hits the positive execution limit 304. FIG. 3D illustrates movement of a membrane when pressure is not equalized across both sides of the transducer membrane. FIG. 3D further thus illustrates how a static offset in a certain direction (i.e., +y-axis direction), may yield asymmetric clipping of an output signal to that same side, as only one side of the movement of the transducer may be clipped. As such, an offset (e.g., displacement) caused by the pressure deviation across the membrane's surfaces may produce distortion in a waveform.

The computing system described herein may be able to detect differences in characteristics between the electrical signals transmitted to a transducer (i.e., provided to and/or received from the transducer) in comparison to expected characteristics of the signal. In some examples, the computing system is able to determine an impedance of certain portions of the audio-generation system (e.g., including that of the speaker and/or the amplifier for the speaker). This impedance value may oscillate as the electrical signal oscillates, and also as the speaker oscillates. The oscillating impedance value may be represented on a graph that has impedance on the y-axis and transducer displacement on the x-axis (where transducer displacement may correspond to analyzed voltage or current of the audio system). The displacement on the x-axis may swing between positive and negative limits. The associated impedance value may reach its upper limits at those limits and may swing down to near zero at the center of the swings. In other words, the graph may show a parabola that is centered with its trough at 0 on the x-axis, at least when pressure is equalized. When pressure is not equalized, the impedance values may shift to the side, for example, so that the parabola moves slightly to the right or to the left, such that the center of the parabola trough is located slightly to the right or to the left of 0 on the x-axis. It is through analysis of this relationship (although not necessarily in graphical form) that the computing system may be able to determine the resting displacement of the speaker membrane.

The system and techniques described herein may monitor waveforms output from the transducer and its components, and various algorithms may be used to electrically detect and compensate for static offset of the membrane, and other pressure deviation events. The disclosed system may modify the audio output signal 328 using a DC offset to electrically compensate for asymmetric clipping that is described in reference to FIGS. 3A-3D. As an example, a DC offset may or other forms of signal modification may be utilized to force the membrane to oscillate about its zero position (as shown in FIG. 3A). As described above, an additional option to modify the audio output signal 328 is to reduce the gain of the signal, which reduces the amplitude of the signal so that asymmetric clipping does not occur. Reducing the gain may achieve more immediate results than DC modifications, so some implementations may involve reducing the gain immediately along with performing modifications to the DC characteristics of the audio signal. Then, as the speaker begins to exhibit changes in its DC characteristics, the gain of the speaker may be gradually increased. As such, there may be a short and immediate decrease in volume representing gain reduction, followed by a somewhat quick modification to DC offset, followed by a slower back off in DC offset as pressure normalizes.

Discussion herein to a computing device or a computing system performing an action includes components of that computing device or computing system performing the action. As an example, electronic device 100 compensating for atypical displacement of a speaker membrane includes one or more processors of the electronic device 100 sending instructions to an amplifier of the electronic device 100 to modify the electrical signals that are provided to the speaker.

Figure 4:
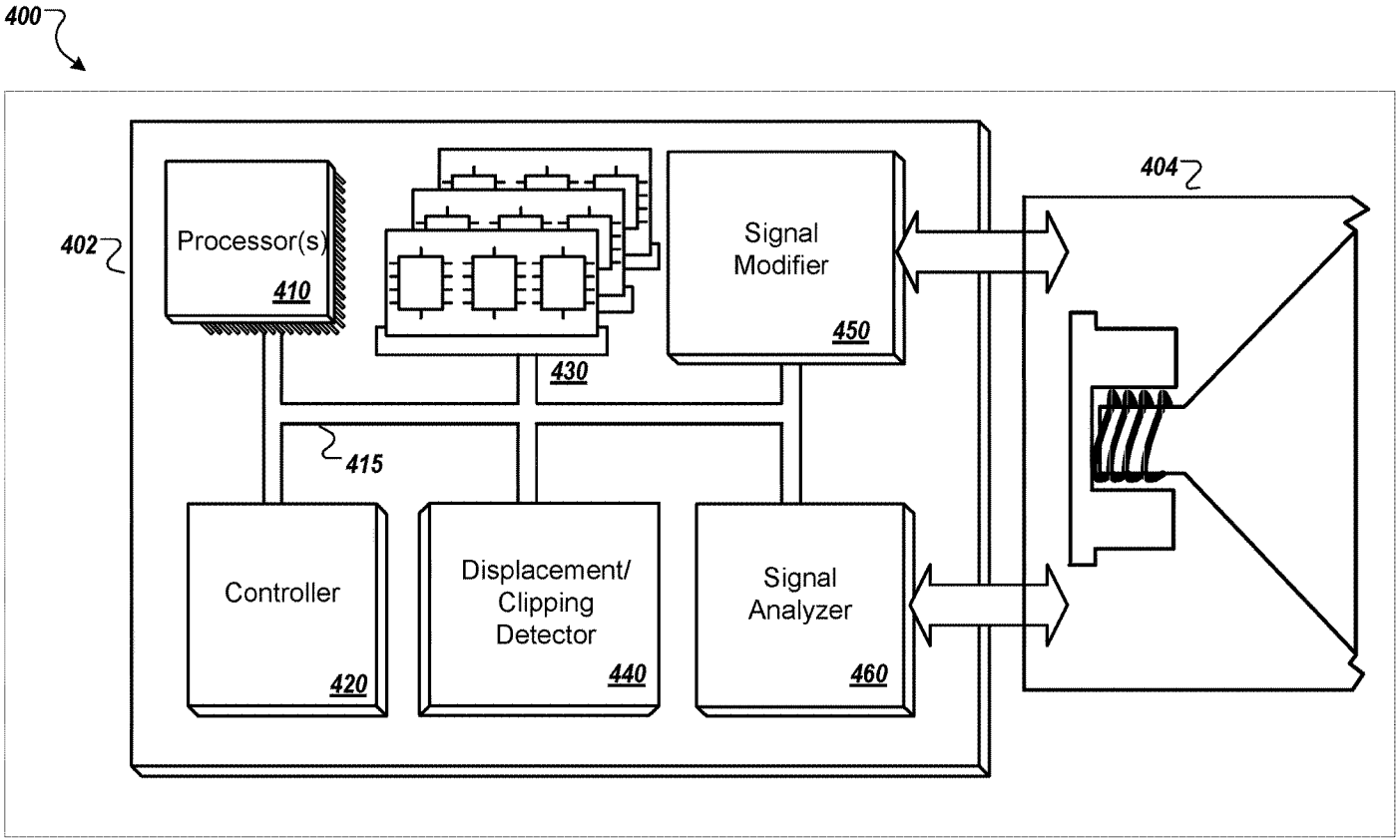
FIG. 4 is a conceptual diagram of a computing system configured to detect atypical displacement of a transducer membrane and compensate for such displacement.

FIG. 4 is a conceptual diagram of a computing system 402 configured to detect atypical displacement of a transducer membrane and compensate for such displacement. The system 402 is shown in communication with an audio transducer 404, or speaker, that may be used to implement the systems and methods described in this document. Electronic device 400 is intended to represent various forms of computing devices, such as mobile devices, personal digital assistants, cellular telephones, smartphones, tablets, and other similar mobile computing devices. Electronic device 400 may also take alternative forms of digital computers, such as laptops, desktops, workstations, personal digital assistants, and other appropriate computers. The components shown here, their connections and relationships, and their functions, are meant to be examples only, and are not meant to limit implementations described and/or claimed in this document.

The computing system 402, may include various components configured to implement the pressure deviation detection and compensation system, as discussed in detail in throughout this disclosure. In some instances, the computing system 400 includes and controls an amplifier, or signal amplification system, or is part of such a system. However, the computing system 402 and its components may be integrated, or communicatively coupled, to various other electronic signal, audio, input/output control, or processing components of an electronic device 400. The computing system 402 may take alternative forms, as circuitry, components, computing devices, and integrated circuits (IC) chips.

Computing system 402 includes a processor 410, controller 420, memory 430, implement/clipping detector 440, signal modifier 450, and signal analyzer 460. Each of the components 410, 420, 430, 440, 450, and 460, are interconnected using various busses 415, and may be mounted on a common motherboard or in other manners as appropriate. The processor 410 may process instructions for execution within the computing system 410, including instructions stored in the memory 430 which may include instructions for performing the pressure deviation detection and compensation techniques described herein. In other implementations, multiple processors 410 and/or multiple buses 415 may be used, as appropriate, along with multiple memories 430 and types of memory. Also, multiple computing systems 402 may be connected, with each device providing portions of the necessary operations (e.g., a multi-processor system).

The signal analyzer 460 may be a computing component configured to analyze various signals that are in communication with the audio transducer 404. In some cases, the signal analyzer 460 is implemented as circuitry for monitoring, or otherwise measuring, electronic signals, such as voltage and current, associated with various aspects of the transducer's function (e.g., input signal, output signal, and traversing signal). Multiple calculations may be performed, using relationships, algorithms, equations, plots, waveforms, and the like, by the signal analyzer 460 in order to determine one or more operating characteristics of the transducer 404 (e.g., inductance, output voltage).

Data generated by the signal analyzer 460 based on the aforementioned measurements, calculations, and analyses, may be communicated to other to components of the computing system 402 to further determine that measured characteristics of the transducer 404 may be indicative of a pressure deviation condition (e.g., atypical displacement, asymmetric clipping). The signal analyzer 640 is capable of monitoring electronic signals in real-time, and further monitoring signals in communication with the transducer 404 that may have been modified by the system 402. In some instances, the signal analyzer 460 is capable of analyzing other forms of waves and signals that may be communicated via the transducer 404, for instance acoustic signals.

The displacement/clipping detector 440 may be a computing component configured to utilize the previously analyzed electronic signals to detect an atypical displacement, or offset, of various transducer components (e.g., coil, magnet, membrane). Additionally, the displacement/clipping detector 440 is configured to detect for asymmetric clipping of an output audio waveform, such as a voltage signal, which may be associated with a static offset of a membrane.

The displacement/clipping detector 440 may employ various known values regarding mechanical characteristics of a transducer 404, such as membrane excursion limits, to determine whether the data associated with analyzed signals signifies that an asymmetric clipping condition has occurred, or may potentially occur. Details regarding implementing the disclosed clipping detection aspects are discussed in detail in reference to FIGS. 3A-3D, among other places throughout this disclosure. The displacement/clipping detector 440 is configured to perform the techniques for static offset asymmetric clipping detection as deemed necessary and appropriate.

The signal modifier 450 may be a computing component capable of electrically compensating for signal degradation, upon detecting an atypical displacement or asymmetric clipping condition. The signal modifier 450 may perform various signal modification procedures based on detection data, communicated from the displacement/clipping detector 440. The signal modifier 450 may perform two main compensation actions, including but not limited to: 1) adjusting the gain of a signal to a level that would prevent, or reduce, an amount of asymmetric clipping; and 2) modifying a signal to affect the DC component of the signal in order to offset, or otherwise oppose, any DC component of the signal that has been determined to be atypical, for instance due to a mechanical offset caused by a pressure difference across the membrane of the transducer 404.

In the case of gain adjustment, the signal modifier 450 may modify the gain of the signal input into the transducer 404, for example reducing the signal's gain by an amount of offset that may be determined by the system to be causing the clipping. Thus, as the signal modifier 450 reduces the gain of the signal proportional to the amount of offset, it in turn lowers its amplitude by that amount (or more) to compensate for the offset to prevent an upper excursion limit from being hit, and therefore to prevent or limit clipping. In some cases, the signal modifier 450 may reduce a signal's gain by a determined level/percentage of shifting that the membrane has experienced due to the pressure deviation.

In some implementations, after an initial gain adjustment, the system 402 may continue to monitor for clipping of any additional signals communicated to the transducer 404. If another clipping condition is detected, the signal modifier 405 may adjust its compensation, by further decreasing the gain or maximum amplitude level until the output signal has no audible distortion. In some implementations, the signal modifier 450 reduces a gain of only some frequencies but not others (or the others are not reduced by as much or are actually increased in gain). An example of this may be reducing the gain of frequencies with higher amplitude components and leaving other components as they are (e.g., by passing the signal through a high pass filter that limits distorting bass).

The signal modifier 450 is also configured to utilize a programmable release time. During compensation, the signal modifier 450 may reduce the gain or the maximum signal limit until a release time, after which the signal may be modified by slowly increasing the gain or maximum signal limit back to their initial levels. The release time may be predetermined, for example using a time constant that is related to the amount of time needed to achieve pressure equalization. The time constant, and similarly release time, may be based on known mechanical characteristics of the device. As an example, the signal modifier 450 may set the release time to be greater than or equal to the time constant, ensuring that the gain modification is not backed off by the system prior to the settling the pressure deviation.

By employing a release time, the signal modifier 450 does not force gain adjustment to last substantially longer than needed to stabilize the air pressure. As a result, the impact to sound quality (e.g., decreased volume) that may be experienced due to the lowered gain, does not perpetually persist after the pressure deviation has ended.

Additionally, the signal modifier 450 may modify the audio signal such that the DC component of the signal is affected. For instance, the signal modifier 450 may add a DC offset voltage that opposes a direction of a measured asymmetric clipping or measured physical offset, to force the membrane away from the approaching threshold and adjust the signal to prevent further clipping or distortion. Moreover, the signal modifier 450 may modify the signal using a DC offset to electrically force the membrane, for example, back to zero its position, thus compensating for a detected displacement. In some implementations, in response to the computing system 402 determining that asymmetric clipping has occurred, the system may modify the electrical signals provided to the transducer 404 to modify the center position of the oscillating speaker membrane. For example, the computing system 402 may apply a DC offset with a positive or negative voltage that is determined to modify the center position of the membrane in a direction away from the asymmetric clipping, and with a magnitude that is based on a detected magnitude of the asymmetric clipping or a magnitude of the detected offset.

In instances in which DC component modification is used, an audio signal may be output at its full gain while the signal modifier 450 adjusts the signal to rest at or oscillate around its intended resting position. Thus, the normal audio signal, or an AC signal component may be communicated on top of the DC compensation. As such, the signal modifier 450 may modify the DC component of a signal to correct for pressure deviation, while the AC component may continue to output the audio output signal.

In order to modify the DC component while applying AC signals, the signal modifier 450 performs tight measurements of the various electronic signals and electrical parameters, and controls the DC signal (e.g., DC servo). As such, the signal modifier 450 may operate in closed loop manner. That is, the signal modifier 450 may continuously update its real-time detection/approximation of the membrane's current position (or average position), in order to determine and dynamically adjust the DC offset applied at the moment, to achieve oscillation about the zero position. Also, in some cases, the signal modifier 450 may employ the time release capabilities to the DC offset compensation techniques also described herein. For instance, the DC offset voltage applied to counteract any atypical displacement may decrease over time.

The memory 430 stores information within the computing device 420. In one implementation, the memory 430 is a volatile memory unit or units. In another implementation, the memory 430 is a non-volatile memory unit or units. The memory 430 may be a non-transitory form of computer-readable medium, such as a magnetic or optical disk.

The controller 420 may be a high-speed controller that manages bandwidth-intensive operations for the computing system 402. In some cases, the controller 420 may take the form of a low speed controller that manages lower bandwidth-intensive operations. Such allocation of functions is an example only. In one implementation, the controller 420 is coupled to memory 420. In some implementations, the system 402 may include various communication ports (e.g., USB, Bluetooth, Ethernet, wireless Ethernet, RF circuitry) may be coupled to one or more input/output devices, such as a keyboard, a pointing device, or a networking device such as a switch or router, e.g., through a network adapter.

The processor 410 may be implemented as a chipset of chips that include separate and multiple analog and digital processors. Additionally, the processor may be implemented using any of a number of architectures. For example, the processor may be a CISC (Complex Instruction Set Computers) processor, a RISC (Reduced Instruction Set Computer) processor, or a MISC (Minimal Instruction Set Computer) processor. The processor 410 may provide, for example, for coordination of the other components of the electronic device 400, such as control of user interfaces, applications run by system 402, and audio output by device 400.

Various implementations of the systems and techniques described here may be realized in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

Figure 5:
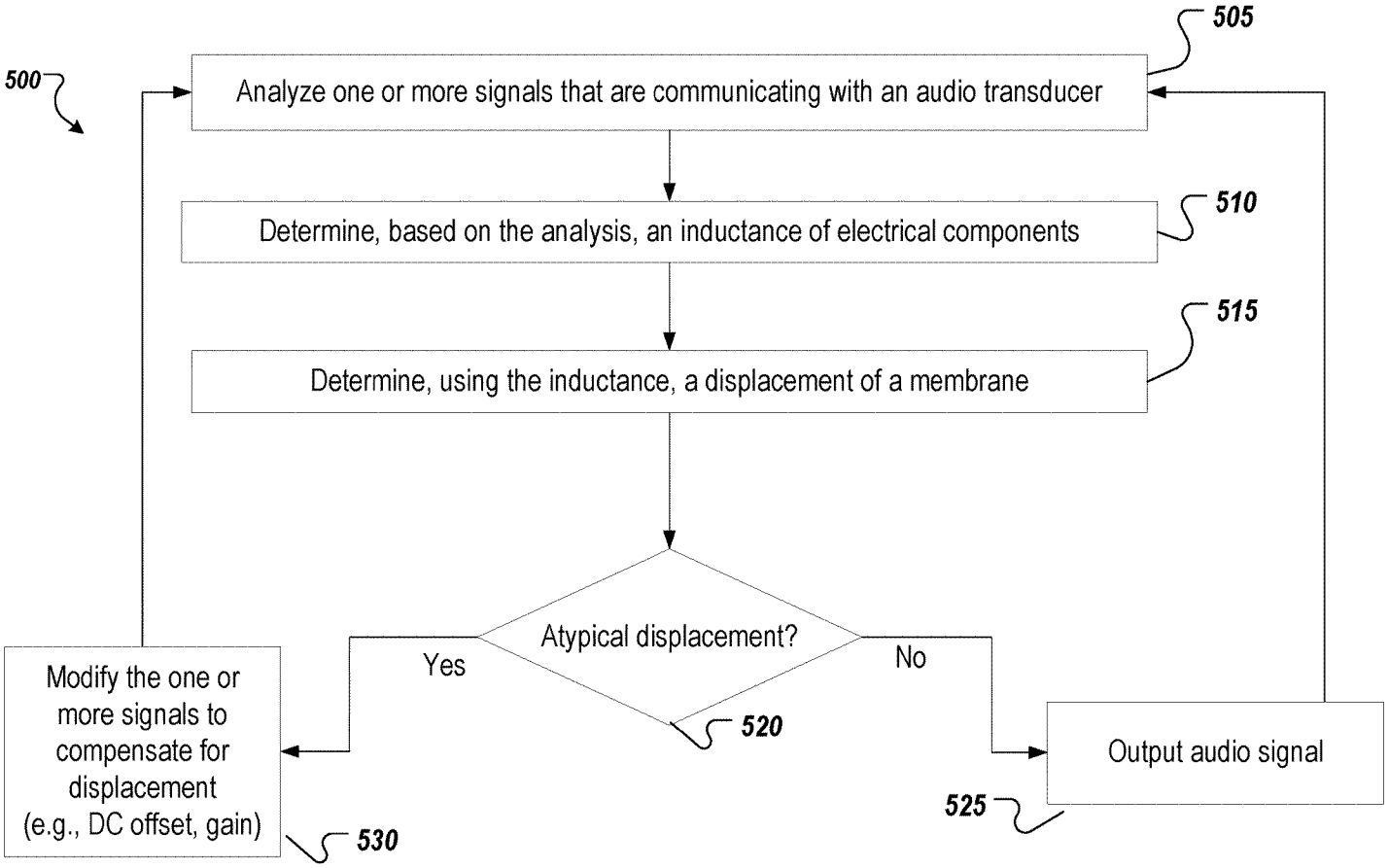
FIG. 5 is a flowchart of an example method for detecting atypical displacement of a transducer membrane and compensating for such displacement.

FIG. 5 is a flowchart of an example method 500 for detecting atypical displacement of a transducer membrane and compensating for such displacement. For example, a mobile telephone may perform the method 500 to compensate for distortion of an audio signal. The distortion may occur due to a user pressing a touchscreen or sitting on the phone, which may cause pressure to vary across the different sides of the membrane/diaphragm of its speaker.

In box 505, the system described herein analyzes one or more signals that are transmitted to an audio transducer of the mobile device (e.g., the signals as they are being output by an amplifier, or the signals after they have been returned from the speaker after amplifier output). The signals may be electronic signals communicated between the system and the transducer, and further used by the transducer in its operation to output an audio signal. In some cases, the analysis of the signals involves measuring a current of the signals and/or the voltage across an electronic component (e.g., a resistor or the speaker). The analysis may employ known relationships between mechanical offsets, such as membrane displacement, and the measured signal characteristics. Additional details regarding various electrical characteristics of the components of a transducer, as well as their measurable electronic signals, are discussed with reference to FIG. 2.

In box 510, the system may determine, based on the analysis, an inductance of one or more electrical components that affect the one or more signals that are in communication with the transducer. For instance, the inductance of the transducer itself may be determined, or otherwise calculated, from the measured current. The determination may involve employing a known mathematical function relating the current (i.e., current input into the transducer) and a voltage (i.e., voltage across an amplifier driving input into the transducer) to determine the inductance of the audio transducer. In some cases, the determination involves calculating an impedance of the transducer over time. Also, various electrical characteristics for components of the transducer may be determined. For example, the inductance of the transducers coil may be determined.

In box 515, the system determines, using the determined inductance, whether the membrane of the audio transducer is experiencing an atypical displacement. Displacement detection may involve analyzing an inductance-displacement curve (e.g., a mathematical representations of values in memory that could be used to generate such a curve), which indicates electrical characteristics of the transducer inductance to expected transducer positions. As an example, the system may determine whether a membrane has shifted from its intended zero position, where the center of membrane oscillation may occur when inductance is at a minimum.

In box 520, a determination is performed to identify whether a determined position of the membrane, based on inductance, signifies atypical displacement. When atypical displacement is not detected at, then the membrane is considered to be operating normally. Accordingly, it may further be derived from the absence of any membrane displacement, that pressure is equalized across the membrane, and that there is low potential of signal degradation due to pressure disparities across the transducer membrane. Under such circumstances, the process moves to box 525, and outputs the audio signal from the transducer, under the assumption that the original signal has no significant distortion that is audible to the user (e.g., no signal modification/compensation).

Alternatively, in the instances where an atypical displacement of the membrane is detected, the method proceeds to box 530. In box 530, the system modifies the one or more signals that are in communication with the transducer to compensate for the atypical displacement of the membrane. Modifying a signal may involve performing at least one corrective action including a gain adjustment, or a DC component offset. The modified signal may be provided to the audio transducer in a manner that electrically compensates for the detected membrane displacement. Thus, after compensation, an audio signal that is output by the audio transducer will have less audible distortion than if the signal remained unmodified. Details regarding signal modification techniques are described in additional detail with reference to FIG. 4. Additionally, after the signal is output in either boxes 525 or 530, the method 500 return to box 505. Accordingly, the method 500 iteratively performs the above-described detection and (sometimes) signal modification actions, thereby continuing to monitor, and (sometimes) compensate for pressure deviation conditions.

These computer programs (also known as programs, software, software applications or code) include machine instructions for a programmable processor, and may be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here may be implemented on a computer having a display device (e.g., a CRT (cathode ray tube) or LCD (liquid crystal display) monitor) for displaying information to the user and a keyboard and a pointing device (e.g., a mouse or a trackball) by which the user may provide input to the computer. Other kinds of devices may be used to provide for interaction with a user as well; for example, feedback provided to the user may be any form of sensory feedback (e.g., visual feedback, auditory feedback, or tactile feedback); and input from the user may be received in any form, including acoustic, speech, or tactile input.

The systems and techniques described here may be implemented in a computing system that includes a back end component (e.g., as a data server), or that includes a middleware component (e.g., an application server), or that includes a front end component (e.g., a client computer having a graphical user interface or a Web browser through which a user may interact with an implementation of the systems and techniques described here), or any combination of such back end, middleware, or front end components. The components of the system may be interconnected by any form or medium of digital data communication (e.g., a communication network). Examples of communication networks include a local area network ("LAN"), a wide area network ("WAN"), peer-to-peer networks (having ad-hoc or static members), grid computing infrastructures, and the Internet.

The computing system may include clients and servers. A client and server are generally remote from each other and typically interact through a communication network. The relationship of client and server arises by virtue of computer programs running on the respective computers and having a client-server relationship to each other.

Further to the descriptions above, a user may be provided with controls allowing the user to make an election as to both if and when systems, programs or features described herein may enable collection of user information (e.g., information about a user's social network, social actions or activities, profession, a user's preferences, or a user's current location), and if the user is sent content or communications from a server. In addition, certain data may be treated in one or more ways before it is stored or used, so that personally identifiable information is removed. For example, a user's identity may be treated so that no personally identifiable information may be determined for the user, or a user's geographic location may be generalized where location information is obtained (such as to a city, ZIP code, or state level), so that a particular location of a user may not be determined. Thus, the user may have control over what information is collected about the user, how that information is used, and what information is provided to the user.

Although a few implementations have been described in detail above, other modifications are possible. Moreover, other mechanisms for performing the systems and methods described in this document may be used. In addition, the logic flows depicted in the figures do not require the particular order shown, or sequential order, to achieve desirable results. Other steps may be provided, or steps may be eliminated, from the described flows, and other components may be added to, or removed from, the described systems. Accordingly, other implementations are within the scope of the following claims.

What is claimed is:

1. A method, comprising:

analyzing, by a computing system, one or more signals transmitted to an audio transducer;

determining, by the computing system and based on the analyzing the one or more signals, an inductance of electronic components affecting the one or more signals;

determining, by the computing system and based on the analysis of the one or more signals transmitted to the audio transducer, that the membrane of the audio transducer is experiencing asymmetric clipping that results in audible distortion to a user from the audio transducer; and modifying, by the computing system and based on using the determined inductance to determine that atypical displacement of the membrane of the audio transducer has occurred, the one or more signals to compensate for the atypical displacement of the membrane of the audio transducer, wherein modifying the one or more signals transmitted to the audio transducer is further based on having determined that the membrane of the audio transducer is experiencing asymmetric clipping and the modification limits the asymmetric clipping of the membrane of the audio transducer.

2. The method of claim 1, wherein:

the one or more signals transmitted to the audio transducer include an oscillating audio signal; and modifying the one or more signals transmitted to the audio transducer includes adjusting a DC component of the oscillating audio signal to compensate for the effects of the atypical displacement of the membrane of the audio transducer and limit the asymmetric clipping of the membrane of the audio transducer.

3. The method of claim 1, wherein determining that the membrane of the audio transducer is experiencing asymmetric clipping includes determining that a characteristic of the one or more signals transmitted to the audio transducer is experiencing clipping.

4. The method of claim 1, wherein determining that atypical displacement of the membrane of the audio transducer has occurred using the determined inductance includes determining that a relationship of the determined inductance to voltage or current has offset at least a threshold amount of volts or amps with respect to an expected relationship of inductance to voltage.

5. The method of claim 1, wherein determining the inductance of the electronic components includes analyzing (i) a current signal that is an input signal for an amplifier of the audio transducer, and (ii) a voltage signal across the amplifier of the audio transducer.

6. The method of claim 1, wherein modifying the one or more signals transmitted to the audio transducer to compensate for the atypical displacement includes reducing a level of the modifying of the one or more signals over a period of time based on pre-determined information that indicates a rate of depressurization.

7. A method, comprising:

analyzing, by a computing system, one or more signals transmitted to an audio transducer, wherein the one or more signals transmitted to the audio transducer includes an oscillating audio signal;

determining, by the computing system and based on the analyzing the one or more signals, an inductance of electronic components affecting the one or more signals; and modifying, by the computing system and based on using the determined inductance to determine that atypical displacement of the membrane of the audio transducer has occurred, the one or more signals to compensate for the atypical displacement of the membrane of the audio transducer, wherein modifying the one or more signals transmitted to the audio transducer includes adjusting a gain of the oscillating audio signal to limit or prevent asymmetric clipping of the membrane of the audio transducer resulting from the atypical displacement of the membrane of the audio transducer, wherein modifying the one or more signals transmitted to the audio transducer to compensate for the atypical displacement includes reducing a level of the modifying of the one or more signals over a period of time based on pre-determined information that indicates a rate of depressurization.

8. The method of claim 7, wherein adjusting the gain of the oscillating audio signal includes reducing a gain of one or more first frequencies of the oscillating audio signal while not reducing a gain of one or more second frequencies of the oscillating audio signal, or modifying the gain of the one or more second frequencies of the oscillating audio signal in a different manner than the reduction in gain to the one or more first frequencies of the audio signal.

9. A system comprising:

an audio transducer;

one or more processors; and one or more computer-readable devices including instructions that, when executed by the one or more processors, causes the system to perform operations that comprise:

analyzing, by a computing system, one or more signals transmitted to an audio transducer;

determining, by the computing system and based on the analyzing the one or more signals, an inductance of electronic components affecting the one or more signals;

determining, by the computing system and based on the analysis of the one or more signals transmitted to the audio transducer, that the membrane of the audio transducer is experiencing asymmetric clipping that results in audible distortion to a user from the audio transducer; and modifying, by the computing system and based on using the determined inductance to determine that atypical displacement of the membrane of the audio transducer has occurred, the one or more signals to compensate for the atypical displacement of the membrane of the audio transducer, wherein modifying the one or more signals transmitted to the audio transducer is further based on having determined that the membrane of the audio transducer is experiencing asymmetric clipping and the modification limits the asymmetric clipping of the membrane of the audio transducer.

10. The system of claim 9, wherein:

the one or more signals transmitted to the audio transducer include an oscillating audio signal; and modifying the one or more signals transmitted to the audio transducer includes adjusting a DC component of the oscillating audio signal to compensate for the effects of the atypical displacement of the membrane of the audio transducer and limit the asymmetric clipping of the membrane of the audio transducer.

11. The system of claim 9, wherein determining that the membrane of the audio transducer is experiencing asymmetric clipping includes determining that a characteristic of the one or more signals transmitted to the audio transducer is experiencing clipping.

12. The system of claim 9, wherein determining that atypical displacement of the membrane of the audio transducer has occurred using the determined inductance includes determining that a relationship of the determined inductance to voltage or current has offset at least a threshold amount of volts or amps with respect to an expected relationship of inductance to voltage.

13. The system of claim 9, wherein determining the inductance of the electronic components includes analyzing (i) a current signal that is an input signal for an amplifier of the audio transducer, and (ii) a voltage signal across the amplifier of the audio transducer.

14. The system of claim 9, wherein modifying the one or more signals transmitted to the audio transducer to compensate for the atypical displacement includes reducing a level of the modifying of the one or more signals over a period of time based on pre-determined information that indicates a rate of depressurization.

15. A system comprising:

an audio transducer;

one or more processors; and one or more computer-readable devices including instructions that, when executed by the one or more processors, causes the system to perform operations that comprise:

analyzing, by a computing system, one or more signals transmitted to an audio transducer, wherein the one or more signals transmitted to the audio transducer includes an oscillating audio signal;

determining, by the computing system and based on the analyzing the one or more signals, an inductance of electronic components affecting the one or more signals; and modifying, by the computing system and based on using the determined inductance to determine that atypical displacement of the membrane of the audio transducer has occurred, the one or more signals to compensate for the atypical displacement of the membrane of the audio transducer, wherein modifying the one or more signals transmitted to the audio transducer includes adjusting a gain of the oscillating audio signal to limit or prevent asymmetric clipping of the membrane of the audio transducer resulting from the atypical displacement of the membrane of the audio transducer, wherein modifying the one or more signals transmitted to the audio transducer to compensate for the atypical displacement includes reducing a level of the modifying of the one or more signals over a period of time based on pre-determined information that indicates a rate of depressurization.

16. The system of claim 15, wherein adjusting the gain of the oscillating audio signal includes reducing a gain of one or more first frequencies of the oscillating audio signal while not reducing a gain of one or more second frequencies of the oscillating audio signal, or modifying the gain of the one or more second frequencies of the oscillating audio signal in a different manner than the reduction in gain to the one or more first frequencies of the audio signal.

* * * * *